US007170388B2

(12) United States Patent
Nakajima

(10) Patent No.: US 7,170,388 B2
(45) Date of Patent: Jan. 30, 2007

(54) THERMOSTAT

(75) Inventor: Yoshihide Nakajima, Shiga (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 253 days.

(21) Appl. No.: 10/944,767

(22) Filed: Sep. 21, 2004

(65) Prior Publication Data

US 2005/0062580 A1 Mar. 24, 2005

(30) Foreign Application Priority Data

Sep. 22, 2003 (JP) ..... 2003-329656

(51) Int. Cl.
*H01H 37/36* (2006.01)
*H01H 37/32* (2006.01)
*H01H 37/38* (2006.01)

(52) U.S. Cl. ..... 337/321; 337/322; 337/323

(58) Field of Classification Search ..... 337/320–323
See application file for complete search history.

(56) References Cited

U.S. PATENT DOCUMENTS 2,100,519 A * 11/1937 Robinson ..... 493/278
3,601,740 A * 8/1971 Fildebrandt ..... 337/311
3,810,249 A * 5/1974 McGowan ..... 392/307
4,194,102 A * 3/1980 Branson et al. ..... 200/454
4,245,142 A * 1/1981 Bauer et al. ..... 200/332
4,363,015 A * 12/1982 Branson et al. ..... 337/117
4,388,605 A * 6/1983 Machida et al. ..... 337/301
4,547,760 A * 10/1985 Rejc ..... 337/323
4,794,363 A * 12/1988 Hirata et al. ..... 337/314
5,142,261 A * 8/1992 Fuller et al. ..... 337/115

FOREIGN PATENT DOCUMENTS

JP S54-45980 U 3/1979
JP 09-139163 5/1997

* cited by examiner

*Primary Examiner*—Anatoly Vortman
(74) *Attorney, Agent, or Firm*—McDermott Will & Emery LLP

(57) ABSTRACT

A thermostat has a switch, a temperature sensor, a lever, a spring, and a control plate. The sensor generates a force to operate switch in response to the ambient temperature. The lever having an arm turns with the force from the sensor to open/close contacts of the switch. The first end of the spring is hooked to the lever to bias a force to the lever in the direction opposite to the force from the sensor. The control plate is hooked to the second end of the spring and is disposed on the lever, allowing a force for turning the lever to increase or to decrease due to turning of the control plate. The control plate turns the arm to perform the forced switch-off operation.

5 Claims, 3 Drawing Sheets

THERMOSTAT

FIELD OF THE INVENTION

The present invention relates to a thermostat having a forced switch-off mechanism.

BACKGROUND ART

In cold regions, a refrigerator is sometimes cut off electric functions completely to be used as a cabinet or a pantry for food storage. Additionally, because of installation location or the like of a refrigerator, user in some cases may want to switch off the power supply without taking trouble to disconnect the plug from the outlet. A thermostat having a forced switch-off mechanism matches both of above needs. Such a thermostat is disclosed for instance in Japanese Utility Model Unexamined Publication No. S54-45980. Next, a conventional thermostat is described with reference to drawings.

FIG. 4 shows a sectional view of a conventional thermostat and FIG. 5 shows a plan view of a cam body of the conventional thermostat. Sensor 1 converts temperature changes in a control section into pressure changes. L-shaped operation member (operation member) 2 makes contact with sensor 1 and can turn around supporting axis 13. An end of spring 3 is hooked near an end of vertical member 2B of operation member 2 and the other end of spring 3 is fixed to screw 4 that is screwed in housing 12. An end of rod 5 is fixed to vertical member 2B of operation member 2 and the other end of rod 5 is fixed to contact plate 6. Contact plate 6 is provided with moving contact 7 on its free end and is fixed to a terminal in the other end. Moving contact 7 connects to or disconnects from stationary contact 8. Cam 10 has curved surface 14 on circular cam body 9 internally. Finger grip shaft 11 protrudes out of housing 12. In the configuration described above, curved surface 14 of cam 10 makes contact with the distal end of vertical member 2B of operation member 2, allowing operation member 2 to slide along curved surface 14.

Next, operations of the thermostat having aforesaid configuration are described. Upon an increase in temperature of the control section, sensor 1 extends to move operation member 2 pivotally counterclockwise around supporting axis 13. When temperature of the control section exceeds a set-temperature, operation member 2 presses rod 5 leftward in the drawing against an elastic force of spring 3 (corresponding to the set-temperature) set by screw 4. Rod 5 presses contact plate 6 to connect moving contact 7 to stationary contact 8, causing a circuit for power supply to be closed.

On the other hand, upon a decrease in temperature of the control section, sensor 1 contracts to move operation member 2 pivotally clockwise around supporting axis 13 with the elastic force of spring 3. Then the pressure on contact plate 6 affected by rod 5 decreases gradually to reverse contact plate 6 at a predetermined temperature, causing moving contact 7 to disconnect from stationary contact 8 thereby causing the circuit for power supply to be opened. Thus, the thermostat can keep the temperature of the control section in a predetermined range.

Next, an operation forcing to open contacts independently of the temperature of the control section is described. Cam body 9 is moved pivotally in the direction indicated by arrow B to make a contact of curved surface 14 with the distal end of vertical member 2B of operation member 2 causing vertical member 2B to slide along curved surface 14. Then curved surface 14 moves operation member 2 pivotally clockwise around supporting axis 13. This releases the pressure affected by rod 5 to contact plate 6 to disconnect moving contact 7 from stationary contact 8. Closed contacts can be thus forced to open.

In the conventional configuration, rotating finger grip shaft 11 can force the thermostat to be switched off. At the time, the distal end of operation member 2 is forced to slide along curved surface 14 of cam body 9. However, a frictional force between the distal end of operation member 2 and curved surface 14, a surface condition of curved surface 14 and the like would likely to increase torque forces to rotate finger grip shaft 11. Moreover, the distal end of operation member 2 is applied pressures in two directions: leftward and frontward in the drawing. As a result, supporting axis 13 of operation member 2 is applied pressures in the similar directions, causing a position of supporting axis 13 to deflect from the position before the forced switch-off operation. This has risks to change the elastic force magnitude of spring 3 causing the set temperature to change.

SUMMARY OF THE INVENTION

A thermostat in the present invention has a switch, a temperature sensor, a lever, a spring, and a control plate. The sensor generates a force to operate the switch in response to an ambient temperature. The lever provided with an arm turns by the force from the sensor to open/close contacts of the switch. The first end of spring is hooked to the lever to apply a biasing force to the lever in the direction opposite to the force from the sensor. The control plate hooks the second end of the spring and is disposed with the lever to increase or to decrease a force needed to move the lever pivotally. The control plate allows the arm to turn causing a forced switch off operation. As the force to affect the arm is determined with a pressure in the direction from the control plate only in this configuration, a torque force to rotate the finger grip shaft can be stable because it would not be influenced by surface conditions or precisions of parts.

DETAILED DESCRIPTION OF THE INVENTION

Figure 1A:
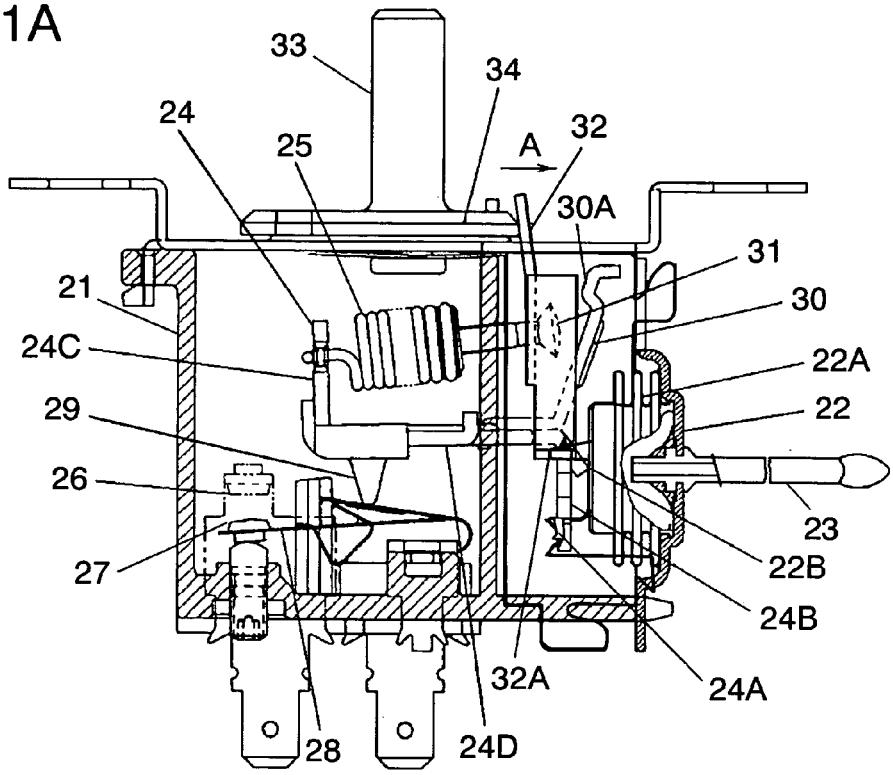
FIG. 1A illustrates a partial perspective sectional view of a thermostat in an exemplary embodiment of the present invention.
Figure 1B:
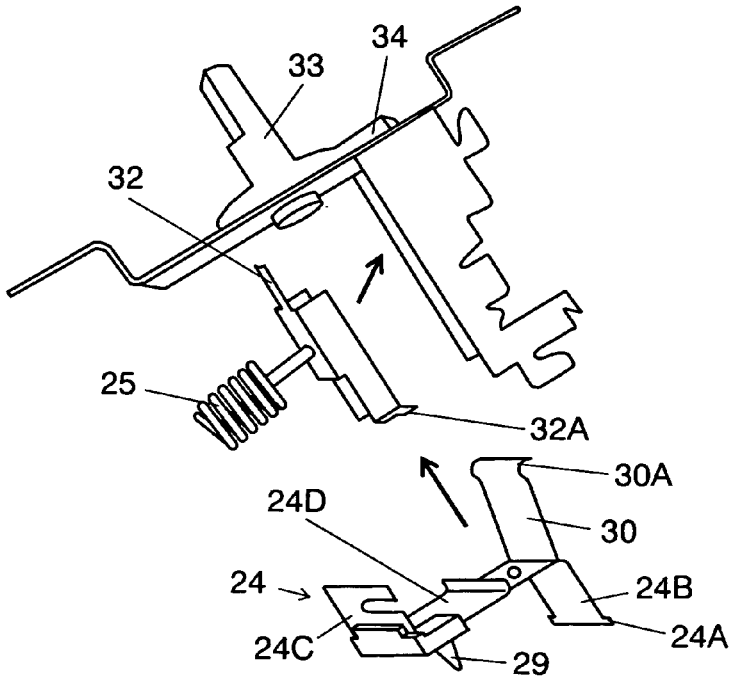
FIG. 1B illustrates an exploded perspective view showing an essential part of the thermostat shown in FIG. 1A.
Figure 2:
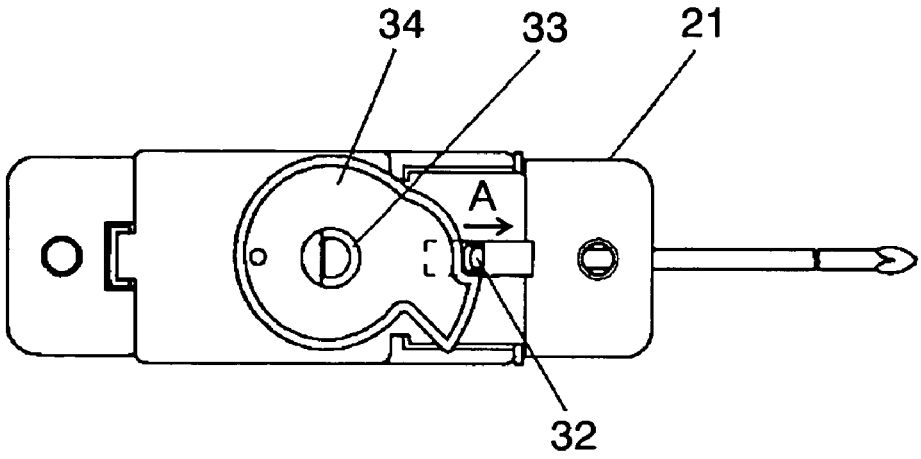
FIG. 2 illustrates a plan view showing a forced switch-off position of a cam of the thermostat shown in FIG. 1A.
Figure 3:
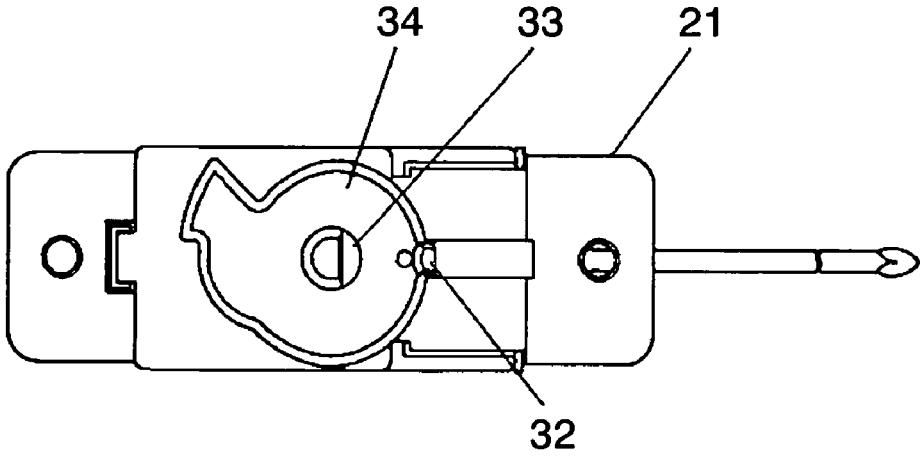
FIG. 3 illustrates a plan view showing a normal use position of the cam of the thermostat shown in FIG. 1A.
Figure 4:
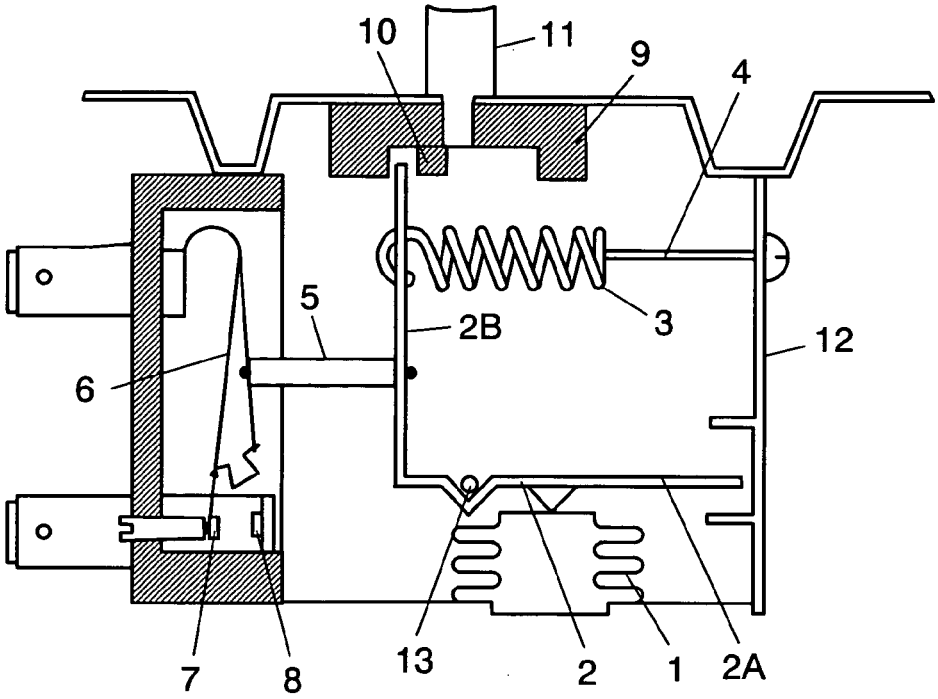
FIG. 4 PRIOR ART
FIG. 4 illustrates a sectional view of a conventional thermostat.
Figure 5:
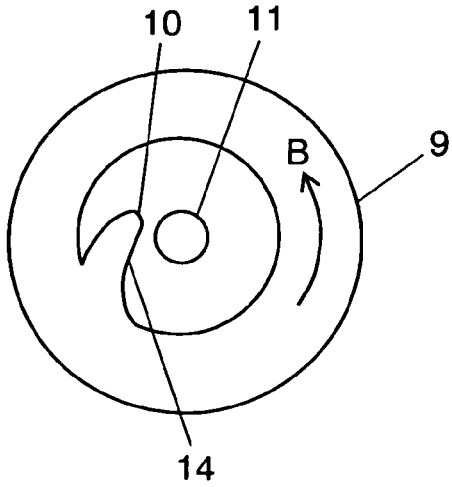
FIG. 5 PRIOR ART
FIG. 5 illustrates a plan view of a cam body of the conventional thermostat.

FIG. 1A illustrates a partial perspective sectional view of a thermostat in an exemplary embodiment of the present invention, FIG. 1B illustrates an exploded perspective view showing an essential part of the thermostat, FIG. 2 illustrates a plan view showing a forced switch-off position of a cam of the thermostat, and FIG. 3 illustrates a plan view showing a normal position of the cam of the thermostat.

As shown in FIGS. 1A, 1B, 2 and 3, temperature sensor 22 is mounted on housing 21. Sensor 22 is provided with bellows 22A to which capillary tube 23 is connected. Capillary tube 23 includes a gas that expand or contract in response to an ambient temperature. Bellows 22A converts volume changes of the gas into a force to operate a switch. Generally Z shaped lever 24 is disposed pivotably around supporting point 24A. First vertical member 24B of lever 24 makes contact with free end 22B of bellows 22A to receive the force from sensor 22. Horizontal member 24D is disposed perpendicular to first vertical member 24B. Second vertical member 24C is disposed on horizontal member 24D on a side identical to arm 30 and is hooked with an end of spring 25 for temperature setting.

Spacer 29 is disposed on horizontal member 24D on a side opposite to second vertical member 24C. Spacer 29 allows switch 28 to be on/off, in which stationary contact 26 makes contact with moving contact 27 and come free from the same. L-shaped arm 30 is disposed on an end of horizontal member 24D. Arm 30 has ridge 30A facing second vertical member 24C of lever 24.

The other end of spring 25 is screwed to control plate 32 via screw 31. Control plate 32 is disposed pivotably around bottom supporting point 32A on housing 21, and the top end of control plate 32 is appressed to cam plate 34 having finger grip shaft 33 for operation temperature setting. Additionally, control plate 32 is disposed in a manner that control plate 32 makes contact with an end of arm 30 only when cam plate 34 turns at a predetermined angle for forced switch-off operation.

Next, the operation of the thermostat having aforesaid configuration is described. Upon an increase in temperature of sensor 22, bellows 22A extends to move lever 24 pivotally counterclockwise around supporting point 24A provided at the end of vertical member 24B. When a temperature of sensor 22 exceeds a set-temperature, lever 24 turns counterclockwise against the elastic force of spring 3 (corresponding to the set-temperature) set by screw 31. Then spacer 29 allows switch 28 to connect stationary contact 26 and moving contact 27 to switch the power supply on.

Contrarily, upon a decrease in temperature of sensor 22, bellows 22A contracts to move lever 24 pivotally clockwise around supporting point 24A due to the elastic force of spring 25. At that time, the pressure affected on switch 28 by spacer 29 decreases gradually, causing moving contact 7 to disconnect from stationary contact 8 to switch the power supply off.

Next, the operation forced to open contacts independently of the temperature of sensor 22 is described. At the forced switch-off operation, control plate 32 turns in the direction indicated by arrow A against an elastic force of spring 3 as shown in FIGS. 1A and 2 by the turn of cam plate 34. At the time, the end of control plate 32 as well as arm 30 disposed on lever 24 turns in the direction indicated by arrow A to move lever 24 pivotally clockwise. This reduces the pressure from spacer 29 causing stationary contact 26 and moving contact 27 to be separated, and the power supply to be switched off. That is, at the forced switch-off operation, arm 30 receives a force in a direction from control plate 32 only. Therefore, torque to rotate finger grip shaft 33 can hardly be influenced by the parts precisions and the surface conditions of arm 30, control plate 32 and cam plate 34. Additionally, when control plate 32 moves arm 30 pivotally for the forced switch-off operation, no force in the bending direction will be applied on the axis of turning, resulting in elimination of the deflection of supporting point 24A, which may be caused by the turning.

As described above, the thermostat disclosed in the embodiment includes switch 28, sensor 22, lever 24 having arm 30, spring 25 and control plate 32. Sensor 22 has bellows 22A and capillary tube 23. Bellows 22A converts expansive or contractive volume changes of a gas therein in response to an ambient temperature to a force for operating switch 28. The force from sensor 22 moves lever 24 pivotally around the supporting point 24A to make stationary contact 26 contact with moving contact 27 of switch 28 and make stationary contact 26 release moving contact 27. That is, sensor 22 can generate a force to operate switch 28 in response to the ambient temperature. Other devices such as bimetals or the like may replace sensor 22. The first end of spring 25 is hooked to lever 24 to bias a force on lever 24 in the direction opposite to the force from sensor 22. Control plate 32 is hooked to the second end of spring 25 and is disposed on lever 24 to turn around the supporting point 32A allowing the force needed for turning of lever 24 to increase or to decrease. Finger grip shaft 33 has cam plate 34 to move control plate 32 pivotally. Arm 30 turns together with control plate 32 to open switch 28, when cam plate 34 moves control plate 32 pivotally at more than a predetermined angle. Additionally, though cam plate 34 enables easier control of the pivotal movement of control plate 32, other way such as for instance a latch, provided on housing 21, that engages with control plate 32 to control pivotal movement positions of control plate 32 may also be acceptable.

In the thermostat with such a configuration, the force to affect arm 30 at the forced switch-off operation is determined with a pressure in only one direction from control plate 32 that is in contact with arm 30.

The torque, therefore, to rotate finger grip shaft 33 is stable because it would not be influenced by dimensional precisions and surface conditions of the parts to achieve a reliable forced switch-off operation. Pivotal movement axes of control plate 32 and lever 24 are placed in parallel with each other. This configuration provides the pivotal movement axis of lever 24 with no bending force when control plate 32 presses lever 24 to turn it. This can eliminate the deflection of supporting point 24A of lever 24, resulting in a stable set temperature, as the elastic force of spring 25 cannot be changed easily. Moreover, raised ridge 30A is provided on arm 30 on the side facing control plate 32 such that control plate 32 makes contact with ridge 30A. This can determine the contacting position of control plate 32 to ridge 30A so that the ratio of displacements of control plate 32 by pivotal movements to displacements of arm 30 has a constant value. Consequently, switch 28 is opened at a predetermined position enabling to allow the forced switch-off operation at a constant angle of cam plate 34. The configuration can provide the thermostat with a high reliability, as arm 30 itself is stronger than a plane structure to improve bearing strength for the forced switch-off operation.

As described above, the thermostat according to the present invention has a high reliability, as the torque to rotate the finger grip shaft is not influenced by the surface conditions and dimensional precisions of parts used. Such a thermostat is suitable for equipment that needs a thermostat with a forced switch-off function for use in cold regions.

What is claimed is:

1. A thermostat comprising:

a switch having contacts;

a sensor generating a force to operate the switch in response to an ambient temperature;

a lever provided with an arm, the lever turning with the force from the sensor to open/close the contacts of the switch;

a spring having a first end hooked to the lever and a second end, the spring biasing a force to the lever in a direction opposite to the force from the sensor; and a control plate hooked to the second end of the spring and disposed on the lever, the control plate increasing/decreasing a force required for turning the lever due to turning of the control plate, wherein the arm turns together with the control plate to open the contacts of the switch when the control plate turns at more than a predetermined angle, and the arm has a ridge provided on a side facing the control plate, the ridge making contact with the control plate.

2. The thermostat of claim 1, wherein the sensor has a capillary tube including a gas that expands /contracts in response to an ambient temperature, and a bellows that converts volume changes of the gas into the force to operate the switch.

3. The thermostat of claim 1, further comprising a cam plate to turn the control plate.

4. The thermostat of claim 1, wherein the lever further has:

a first vertical member to receive the force from the sensor;

a horizontal member perpendicular to the first vertical member;

a second vertical member disposed on a side identical to the arm according to the horizontal member and hooked with the first end of the spring; and a spacer disposed on the horizontal member on a side opposite to the second vertical member, the spacer operating the switch, and the lever turns around an end of the first vertical member.

5. The thermostat of claim 1, wherein an axis of turning of the control plate and an axis of turning of the lever are disposed in parallel with each other.

* * * * *